US011160301B2

(12) United States Patent
Klipfel et al.

(10) Patent No.: US 11,160,301 B2
(45) Date of Patent: *Nov. 2, 2021

(54) METHOD FOR THE PRODUCTION OF HOMOGENIZED TOBACCO MATERIAL

(71) Applicant: PHILIP MORRIS PRODUCTS S.A., Neuchatel (CH)

(72) Inventors: Yorick Klipfel, St. Saphorin-sur-Morge (CH); Johannes Petrus Maria Pijnenburg, Neuchatel (CH); Michael Elliott Doyle, Ridgeway, VA (US); Juan David Manzur Bedoya, Lutry (CH); Pascal Rausis, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 62 days.

This patent is subject to a terminal disclaimer.

(21) Appl. No.: 16/553,373

(22) Filed: Aug. 28, 2019

(65) Prior Publication Data

US 2019/0380376 A1 Dec. 19, 2019

Related U.S. Application Data

(63) Continuation of application No. 15/503,805, filed as application No. PCT/EP2015/070653 on Sep. 9, 2015, now Pat. No. 10,420,365.

(30) Foreign Application Priority Data

Sep. 30, 2014 (EP) ..... 14187201

(51) Int. Cl.
*A24B 3/08* (2006.01)
*A24B 15/14* (2006.01)
(Continued)

(52) U.S. Cl.
CPC ..... *A24B 3/08* (2013.01); *A24B 3/14* (2013.01); *A24B 3/18* (2013.01); *A24B 15/14* (2013.01); *A24B 15/28* (2013.01); *A24C 5/01* (2020.01)

(58) Field of Classification Search
None
See application file for complete search history.

(56) References Cited

U.S. PATENT DOCUMENTS 2,433,877 A 1/1948 Wells
3,867,951 A 2/1975 Buchman
(Continued)

FOREIGN PATENT DOCUMENTS

CN 1044853 10/1993
CN 1281341 A 1/2001
(Continued)

OTHER PUBLICATIONS

Particle Size Conversion Table, Sigma-Aldrich Chemicals-Technical Library, 2004, [online], retrieved from the Internet, [retrieved Mar. 29, 2017], <URL: https://www.sigmaaldrich.com/chemistry/stockroom-reagents/learning-center/technical-library/particle-size-conversion.html> (Year: 2004).*
(Continued)

*Primary Examiner* — Dennis R Cordray
(74) *Attorney, Agent, or Firm* — Mueting Raasch Group

(57) ABSTRACT

The present invention relates to method for production of a slurry for homogenized tobacco material, said method comprising:
Selecting tobacco of one or more tobacco types;
Coarse grinding said tobacco;
Blending said tobacco of one or more tobacco types; and
Fine grinding said tobacco of one or more tobacco types.

13 Claims, 5 Drawing Sheets

(51) Int. Cl.

| | |
|---|---|
| ***A24B 3/18*** | (2006.01) |
| ***A24B 15/28*** | (2006.01) |
| ***A24B 3/14*** | (2006.01) |
| ***A24C 5/01*** | (2020.01) |

(56) References Cited

U.S. PATENT DOCUMENTS

| | | | | |
|---|---|---|---|---|
| 4,306,578 | A | 12/1981 | Schmidt | |
| 5,211,252 | A | 5/1993 | Henderson | |
| 5,724,998 | A | 3/1998 | Gellatly | |
| 10,420,365 | B2 * | 9/2019 | Klipfel ..... | A24B 3/18 |
| 2008/0216851 | A1 | 9/2008 | Olegario | |

FOREIGN PATENT DOCUMENTS

| | | | |
|---|---|---|---|
| CN | 103431514 | | 11/2013 |
| EP | 565360 | A2 * | 4/1993 |
| EP | 0565360 | | 10/1993 |
| EP | 2526787 | A1 * | 5/2011 |
| EP | 2526787 | | 11/2012 |
| GB | 1331914 | | 9/1973 |
| GB | 1331914 | A * | 9/1973 |
| JP | 52-014400 | | 2/1977 |
| JP | 63-248378 | | 10/1988 |
| JP | 04-228042 | | 8/1992 |
| WO | WO 81/00001 | | 1/1981 |
| WO | WO 81/00001 | A1 * | 1/1981 |
| WO | WO 99/29190 | | 6/1999 |
| WO | WO 99/29190 | A1 * | 6/1999 |
| WO | WO 2014/125251 | | 8/2014 |
| WO | WO 2014/140346 | | 9/2014 |

OTHER PUBLICATIONS

Office Action issued in China for Application No. 201580049818.5 dated Oct. 11, 2017 (16 pages). English translation included.

Office Action issued in China for Application No. 201580049818.5 dated Feb. 7, 2018 (17 pages). English translation included.

"Cigarette Technology", Yu Jianjun, pp. 349-352, China Agriculture Press, 1st Edition, Jul. 31, 2003.

"Supporting Agricultural Machinery for Hand Tractor", Department of Agricultural Mechanism Management, Ministry of Agriculture, pp. 134-136, 139, Southeast University Press, 1st Edition, May 31, 1994.

Particle Size Conversion Table, Sigman-Aldrich Chemicals-Technical Library, 2004, [online], retrieved from the Internet, [retrieved Mar. 29, 2017], <URL:https://www.sigmaaldrich.com/chemistry/stockroom-reagents/learning-center/technical-library/particle-size-conversion.html>. (Year: 2004).

Office Action issued in Europe for Application No. 18195498.3-1105 dated Feb. 14, 2019 (10 pages).

Office Action issued in Japan for Application No. 2017-516335 dated Sep. 9, 2019 (15 pages). English translation included.

Office Action issued in Brazil for Application No. BR112017003797 dated Dec. 11, 2019 (5 pages). English translation included.

* cited by examiner

METHOD FOR THE PRODUCTION OF HOMOGENIZED TOBACCO MATERIAL

This application is a continuation of U.S. application Ser. No. 15/503,805, filed Feb. 14, 2017, and which is U.S. National Stage Application of International Application No. PCT/EP2015/070653, filed Sep. 9, 2015, which was published in English on Apr. 7, 2016 as International Publication No. WO 2016/050469 A1. International Application No. PCT/EP2015/070653 claims priority to European Application No. 14187201.0 filed Sep. 30, 2014. A certified copy of European Application No. 14187201.0 filed Sep. 30, 2014, was provided in, and is available in, U.S. patent application Ser. No. 15/503,805 for which certified copy is available in PAIR This invention relates to a process for producing homogenized tobacco material. In particular, the invention relates to a process for producing homogenized tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore it is important to have good control over the composition of the homogenized tobacco material, for the control for example, of the taste of the aerosol. The use of tobacco dust or leftovers from other tobacco productions for the production of homogenized tobacco material for aerosol-generating article is therefore less suitable because the exact composition of the tobacco dust is not known.

There is therefore a need for a new method of preparing a homogenized tobacco material for the use in a heated aerosol-generating article of the "heat-not-burn" type that is adapted to the different heating characteristics and aerosol forming needs of such a heated aerosol-generating article.

According to a first aspect, the invention relates to a method for production of homogenized tobacco material, said method comprising the steps of selecting tobacco of one or more tobacco types, grinding said selected tobacco and blending said tobacco of one or more tobacco types. According to the invention, the step of grinding comprises the two distinct steps of coarse grinding and fine grinding said tobacco of one or more tobacco types.

As the tobacco present in the homogenized tobacco material constitutes substantially the only—or the majority of—tobacco present in the aerosol-generating article, the impact on the characteristics of the aerosol, such as for example its flavour, derives predominantly from the homogenized tobacco material. According to the invention, therefore, the ingredients for the homogenized tobacco material are blended such that the origin of all elements of the resulting blended tobacco powder is known. This is a significant advantage over conventional reconstituted tobacco sheets, where the exact composition of the tobacco dust that is used for the preparation is not entirely known. The blending of the tobaccos for the production of the homogenized tobacco material therefore allows setting and meeting predetermined target values for certain characteristics of the resulting blend of different types of tobacco, such as, for example, the flavour characteristics. The starting material for the production of homogenized tobacco material for aerosol-generating article according to the invention is mostly tobacco leaf that has thus the same size and physical properties as the tobacco for the blending of cut filler that is tobacco leaves. Accordingly, in order to obtain a homogeneous homogenized tobacco material, the tobacco lamina for the homogenized tobacco material needs to be ground into powder in order to reach substantially the same size as the "dust" used in the reconstituted tobacco material of the prior art. Too big tobacco particles, that is, tobacco particles bigger than about 0.15 millimetres, may be the cause of defects and inhomogeneous areas in the homogenized tobacco web that is formed from the tobacco powder. The effect is increased the thinner the web of tobacco material is. Defects in the homogenized tobacco web may reduce the tensile strength of the homogenized tobacco web. A reduced tensile strength may lead to difficulties in subsequent handling of the homogenized tobacco web in the production of the aerosol-generating article and could for example cause machine stops due to partial or complete tearing of the tobacco web. Additionally, an inhomogeneous tobacco web may create unintended difference in the aerosol delivery between aerosol generating articles that are produced from the same homogenized tobacco web. Therefore, a relatively small mean particle size is desired as a starting tobacco material to form the slurry to obtain acceptable homogenized tobacco material for aerosol-generating articles. Further, it has been found that the aerosolization of substances from the tobacco can be improved if the tobacco powder is of the same size or below the size of the tobacco cell structure. It is believed that fine grinding to about 0.05 millimetres can advantageously open the tobacco cell structure.

However, opening the cell structure by fine grinding requires a relatively large amount of energy. This is believed to be at least partially caused by the tobacco powder becoming sticky once the cell structure is destroyed. The fine grinding of the tobacco powder creates high friction and elevated temperatures in the fine grinding apparatus. This can lead to a congestion of the fine grinding machinery, reducing the production speed. Thus, the energy that can be used to grind the tobacco into very fine powder is limited to prevent overheating of the fine grinding apparatus and possibly the tobacco powder. Overheating the tobacco powder may lead to a degradation of the material, and change the physical properties of the tobacco material and the aerosol that can be released form the tobacco material. On the other hand, the mass flow and production speed of the line depends on the energy that can be utilised to fine grind the tobacco. According to the invention, the problem is solved by splitting the grinding process into a coarse grinding step and a separate fine grinding step. Accordingly, a maximum amount of energy can be put into the tobacco powdering in a first coarse grinding stage, thus reducing the amount of energy needed for the final fine grinding stage. In turn, this can greatly increase the mass flow of tobacco powder through the fine grinding apparatus. At the same time, unintended degradation of the tobacco material due to the fine grinding can be reduced.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering of one or both of tobacco leaf lamina and tobacco leaf stems.

In addition, homogenized tobacco material may comprise a minor quantity of one or more of tobacco dust, tobacco fines, and other particulate tobacco by-products formed during the treating, handling and shipping of tobacco.

Homogenized tobacco material may comprise one or more intrinsic binders, one or more extrinsic binders, or a combination thereof to help agglomerate particles of tobacco. Homogenized tobacco material may comprise other additives including, but not limited to, tobacco and non-tobacco fibres, aerosol-formers, humectants, plasticisers, flavourants, fillers, aqueous and non-aqueous solvents, and combinations thereof.

When intended for use as an aerosol-forming substrate of a heater aerosol-generating article, it may be preferred that the homogenized tobacco has an aerosol-former content greater than about 5 percent on a dry weight basis. Preferably, reconstituted tobacco for use in heated aerosol-generating articles may have an aerosol-former content of between about 5 percent and about 30 percent by weight on a dry weight basis.

In the present invention, the slurry is formed by tobacco lamina and stem of different tobacco types, which are properly blended. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent on dry weight basis of the leaf and a total ammonia content of less than about 0.12 percent on dry weight basis of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

According to the invention, different grades within the same tobacco type may be cross-blended to reduce the variability of each blend component. According to the invention, the different tobacco grades are selected in order to realize a desired blend having specific predetermined characteristics. For example, the blend may have a target value of the reducing sugars, total ammonia and total alkaloids per dry weight base of the homogenized tobacco material. Total alkaloids are for example nicotine and the minor alkaloids including nornicotine, anatabine, anabasine and myosmine.

For example, bright tobacco may comprise tobacco of grade A, tobacco of grade B and tobacco of grade C. Bright tobacco of grade A has slightly different chemical characteristics to bright tobacco of grade B and grade C. Aromatic tobacco may include tobacco of grade D and tobacco of grade E, where aromatic tobacco of grade D has slightly different chemical characteristics to aromatic tobacco of grade E. A possible target value for the tobacco blend, for the sake of exemplification, can be for example a content of reducing sugars of about 10 percent in dry weight basis of the total tobacco blend. In order to achieve the selected target value, a 70 percent bright tobacco and a 30 percent aromatic tobacco may be selected in order to form the tobacco blend. The 70 percent of the bright tobacco is selected among tobacco of grade A, tobacco of grade B and tobacco of grade C, while the 30 percent of aromatic tobacco is selected among tobacco of grade D and tobacco of grade E. The amounts of tobaccos of grade A, B, C, D, E which are included in the blend depend on the chemical composition of each of the tobaccos of grades A, B, C, D, E so as to meet the target value for the tobacco blend.

The various tobacco types are in generally available in lamina and stems. In order to produce a slurry for a homogenized tobacco material, the selected tobacco types have to be ground in order to achieve a proper tobacco size, for example a tobacco size which is suitable for forming a slurry.

In order to minimize the energy used during the grinding phase, according to the invention, the grinding phase is divided into two steps. According to the invention, the coarse grinding step comprises grinding tobacco strips into the smallest possible size while at the same time the cell structure of the tobacco remains substantially undamaged. Thus, the coarsely ground tobacco particles remain substantially dry. This is advantageous as the dry tobacco particles can be handled easily, for example for storing, blending and other subsequent processes. It has been found that, due to the inclusion of the coarse grinding step, the energy consumption in the fine grinding step can be advantageously reduced by about 30 percent. This reduction in energy consumption in the fine grinding step is therefore available to increase the possible throughput through the fine grinding step when the energy consumption is kept at the same level as without the coarse grinding. Advantageously, this also allows decreasing the cost of production as less sophisticated machinery needs to be utilized to manufacture the coarse ground tobacco particles than is required for the manufacture of fine ground tobacco powder.

In a first step of the method of the invention the tobacco is coarse grinded, that is, it is reduced to a particle size in which the cells of the tobacco are on average not broken or destroyed. Advantageously, at this stage, the resulting coarse ground tobacco stays dry, such that any viscous or sticky behaviour of the resulting coarse ground tobacco is avoided.

After this first coarse grinding step, in an additional grinding step, the tobacco is ground into a tobacco powder with a mean particle size which is suitable for the formation of a slurry. In this second grinding step, the cells of the tobacco are to some extent or completely destroyed.

By reducing the tobacco powder mean size less binder may be required to form the homogenized tobacco webs described herein. It is also believed that by fine grinding the tobacco to a finer powder size, substances within the tobacco cell can be released easier from the tobacco cells, such as for example pectin, nicotine, essential oils and other flavours.

Preferably, the coarse grinding of the tobacco can be done in parallel, for example a process line for each tobacco type used in the blend. Alternatively, coarse grinding of the tobacco can be done in series, that is one tobacco type after the other. The first embodiment is preferred in case the different tobacco types need a different processing during the coarse grinding.

The blending of different tobacco types selected according to the invention in order to obtain the desired blend can be performed either before the coarse grinding, that is, at the level of the lamina and stems, or after the coarse grinding. Advantageously, the step of blending follows the step of coarse grinding. At this stage handling of the coarsely ground tobacco material is still easy. At the same time, this allows inline blending at a single production facility. Further, an intermediate boxing and storing process of blended tobacco leafs or strips is not required. Advantageously, the selected tobaccos for the tobacco powder can be delivered in standard shipping crates for tobacco leafs to the facility in which the coarse ground tobacco particles are manufactured. At the exit of the facility in which the coarse ground tobacco particles are manufactured, the coarsely ground tobacco particles can be transported inline to the fine grinding and casting machinery. Alternatively, the coarsely ground tobacco particles can be packed and shipped to the facility with the fine grinding and casting machinery. Preferably, the fine grinding and casting machinery are at the same location due to the physical properties of the tobacco powder after the fine grinding (for example due to the destruction of the protective cell structure of the tobacco that leads to the release of intrinsic binders).

Alternatively, the blending can be realized after the fine grinding step, so tobacco powder made of different tobacco types or grades is blended.

Preferably, the step of fine grinding the selected tobaccos comprises fine grinding said tobacco down to a tobacco powder having a mean size of between about 0.03 millimetres and about 0.12 millimetres. The mean size of between about 0.03 millimetres and about 0.12 millimetres represents the size at which the tobacco cells are at least in part destroyed by the grinding. Moreover, the slurry obtained using the powder of tobacco having this mean size is smooth and uniform. In the following, the term "tobacco powder" is used through the specification to indicate tobacco having a mean size of between about 0.03 millimetres and about 0.12 millimetres.

Preferably, the step of coarse grinding according to the invention comprises coarse grinding said tobacco leaves to obtain tobacco particles of a mean size of between about 0.25 millimetres and about 2.0 millimetres, more preferably, a mean size of between about 0.3 millimetres and about 1.0 millimetres and most preferably, a mean size of between about 0.3 millimetres and about 0.6 millimetres. At the size of between about 0.25 millimetres and about 2 millimetres, the cells of the tobacco are still substantially intact such that the handling of the coarse ground tobacco is relatively easy. In particular, at this size, the tobacco particles remain essentially dry and non-sticky. The amount of energy that is allocated to the fine grinding process is inverse proportional to the particle size. That is, the smaller the size of the after the particles at the coarse grinding stage, the more energy can is allocated to the coarse grinding process. Accordingly, the amount of energy that is required for the subsequent fine grinding process can be advantageously reduced. In the following, the term "tobacco particles" is used through the specification to indicate tobacco having a mean size of between about 0.25 millimetres and about 2.0 millimetres.

In an advantageous embodiment, the method of the invention, before said coarse grinding, further comprises the step of shredding said tobacco to obtain tobacco strips having a mean size of between about 2 millimetres and about 100 millimetres.

Dividing the tobacco particle size reduction into a plurality of separated steps, further reduces the overall energy consumption during each individual reduction step. Therefore, preferably, also the step of grinding the tobacco from the lamina and stem size to a particle size of between about 0.3 millimetres and about 2 millimetres is performed in two sub-steps, a first shredding step where the tobacco is shredded up to a mean size of few centimetres and then the coarse grinding step up to the desired size from about 0.3 millimetres to about 2 millimetres. Obviously, where the earlier shredding process reduces the particle size below the size of about 2 millimetres, the subsequent coarse grinding step reduces the particle size further to a smaller range.

Advantageously, the step of selecting tobacco of one or more tobacco types comprises selecting at least about 30 percent of bright tobacco in dry weight basis of total amount of tobacco in the blend; between about 0 percent and about 40 percent of dark tobacco in dry weight basis of total amount of tobacco in the blend; and between about 0 percent and about 40 percent of aromatic tobacco in dry weight basis of total amount of tobacco in the blend. Where the homogenized tobacco material prepared according to the method of the invention is to be used in an aerosol-forming article, the flavour, taste and chemical composition of the aerosol generated by the device derives almost entirely from the compounds present in the slurry which is then transformed into the homogenized tobacco material. According to the invention, the tobacco blend present in the slurry, and then in turn in the homogenized tobacco material, contains only small amounts, for example less than about 5 percent in dry weight basis of total amount of tobacco in the blend, of the leftovers of other tobacco production processes. Advantageously, the tobacco blend is a blend of different tobacco types and grades which is obtained in an analogous manner as in the cigarette blending process. In particular, this means that different types of tobacco are selected to obtain the desired specific blend having certain specific predetermined characteristics. For example, selected characteristics can be one or more of reducing sugar, total ammonia and total alkaloids in the tobacco blend.

Preferably, the method of the invention comprises the step of adding a binder to the blend of different tobacco types of between about 1 percent and about 5 percent in dry weight basis of the homogenized tobacco material. In addition to controlling the sizes of the tobacco powder used in the process of the present invention, it is also advantageous to add a binder, such as any of the gums or pectins described herein, to ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Advantageously, the method according to the invention comprises the step of adding a aerosol-former to the blend of different tobacco types of between about 5 percent and about 30 percent dry weight of the slurry.

Suitable aerosol-formers for inclusion in slurry for webs of homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, where the homogenized tobacco material according to the specification is intended for use as aerosol-forming substrates in heated aerosol-generating articles, webs of homogenised tobacco material may have an aerosol former or humectant content of between about 5 percent and about 30 percent by weight on a dry weight basis, preferably between about 15 percent and about 20 percent. Homogenized tobacco material intended for use in electrically-operated aerosol-generating system having a heating element may preferably include an aerosol former of greater than 5 percent to about 30 percent. For homogenized tobacco material intended for use in electrically-operated aerosol-generating system having a heating element, the aerosol former may preferably be glycerol.

More preferably, the method of the invention comprises the step of mixing the binder and the aerosol-former before adding the binder and the aerosol-former to the blended tobacco powder. Pre-mixing the binder and the aerosol-former before mixing the rest of the slurry has the advantage that, otherwise, the binder may gel when it is put in contact with water. The gelling may lead to an unintended non-uniform mixing of a slurry used to produce the homogenized tobacco material. To avoid or postpone as much as possible this gelation, it is preferred that the binder and the aerosol-former are mixed together before the introduction of any other compound in the slurry so that the binder and the aerosol-former can form a suspension.

Advantageously, said tobacco powder blend forms between about 20 percent and about 93 percent in dry weight basis of the homogenized tobacco material. More preferably, the tobacco powder blend forms between about 50 percent and about 90 percent in dry weight basis of the homogenized tobacco material. The preferred amount of tobacco powder also depends on the tobacco web forming process.

Preferably, the method according to the invention comprises the step of adding a cellulose pulp to said grinded blend of tobacco powder in an amount between about 1 percent and about 3 percent in dry weight basis of said homogenized tobacco material.

A cellulose pulp includes water and cellulose fibres. Cellulose fibres for including in a slurry for homogenized tobacco material are known in the art and include, but are not limited to: soft-wood fibres, hard wood fibers, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Fibres particles may include tobacco stem materials, stalks or other tobacco plant material. Preferably, cellulose-based fibres such as wood fibres comprise a low lignin content. Fibres particles may be selected based on the desire to produce a sufficient tensile strength for the cast leaf. Alternatively fibres, such as vegetable fibres, may be used either with the above fibres or in the alternative, including hemp and bamboo.

During the processing from the slurry to a final homogenized tobacco material to be cut and introduced in an aerosol-generating device, homogenized tobacco sheets are often required to withstand wetting, conveying, drying and cutting. The ability of the homogenized tobacco web to withstand the rigors of processing with minimal breakage and defect formation is a highly desirable characteristic since it reduces the loss of tobacco material. The introduction of cellulose fibres in the slurry increases the tensile strength to traction of the web of material, acting as a strengthening agent. Therefore adding cellulose fibres may increase the resilience of the homogenized tobacco material web and thus reduce the manufacturing cost of the aerosol-generating device and other smoking articles.

The density of the slurry, in particular before a step of casting the slurry to form a homogenized tobacco web, is important for determining the end quality of the web itself. A proper slurry density and homogeneity minimizes the number of defects and maximizes tensile strength of the web.

Advantageously, the method includes the step of forming a slurry including said blend of tobacco powder and the step of casting a web of the slurry into a continuous tobacco web.

The homogenized tobacco material may be cast leaf tobacco. The slurry used to form the cast leaf includes tobacco powder and preferably one or more of fibre particles, aerosol formers, flavours, and binders. Tobacco powder may be of the form of powder having a mean size on the order between about 0.03 millimetres and about 0.12 millimetres depending on the desired web thickness and casting gap.

A web of homogenized tobacco material is preferably formed by a casting process of the type generally comprising casting a slurry prepared including the blend of tobacco powder above described on a support surface. Preferably, the cast web is then dried to form a web of homogenized tobacco material and it is then removed from the support surface.

Preferably, the moisture of said cast tobacco material web at casting is between about 60 percent and about 80 percent of the total weight of the tobacco material at casting. Preferably, the method for production of a homogenized tobacco material comprises the step of drying said cast web, winding said cast web, wherein the moisture of said cast web at winding is between about 7 percent and about 15 percent of dry weight of the tobacco material web. Preferably, the moisture of said homogenized tobacco web at winding is between about 8 percent and about 12 percent of dry weight of the homogenized tobacco web.

A second aspect of the invention is directed to an aerosol-generating article, comprising a portion of homogenized tobacco material that has been prepared according to the method as described above. An aerosol-generating article is an article comprising an aerosol-forming substrate that is capable of releasing volatile compounds that can form an aerosol. An aerosol-generating article may be a non-combustible aerosol-generating article or may be a combustible aerosol-generating article. Non-combustible aerosol-generating article releases volatile compounds without the combustion of the aerosol-forming substrate, for example by heating the aerosol-forming substrate, or by a chemical reaction, or by mechanical stimulus of an aerosol-forming substrate. Combustible aerosol-generating article releases an aerosol by direct combustion of an aerosol-forming substrate, for example as in a conventional cigarette.

The aerosol-forming substrate is capable of releasing volatile compounds that can form an aerosol volatile compound and may be released by heating or combusting the aerosol-forming substrate. In order for the homogenized tobacco material to be used in an aerosol-forming generating article, aerosol formers are preferably included in the slurry that forms the cast leaf. The aerosol formers may be chosen based on one or more of predetermined characteristics. Functionally, the aerosol former provides a mechanism that allows the aerosol former to be volatilize and convey nicotine and/or flavouring in an aerosol when heated above the specific volatilization temperature of the aerosol former.

The invention will be further described, by way of example only, with reference to the accompanying drawings in which.

Figure 1:
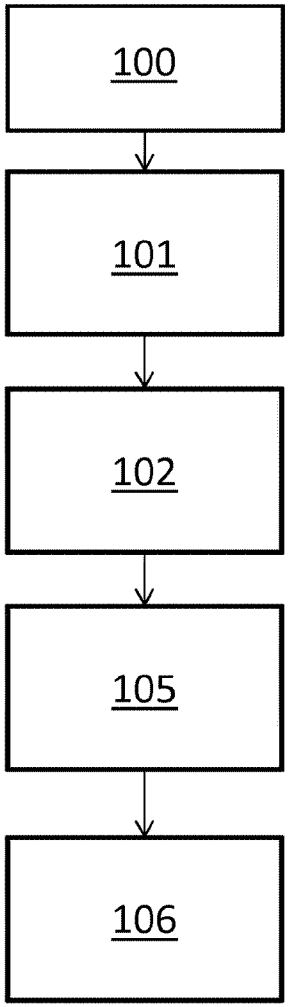
FIG. 1 shows a flow diagram of a method to produce slurry for homogenized tobacco material according to the invention.

With initial reference to FIG. 1, a method for the production of slurry according to the present invention is represented. The first step of the method of the invention is the selection 100 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

Only the selected tobacco types and tobacco grades intended to be used for the production of the homogenized tobacco material undergo the processing according to following steps of the method of the invention.

The method includes a further step 101 in which the selected tobacco is laid down. This step may comprise checking the tobacco integrity, such as grade and quantity, which can be for example verified by a bar code reader for product tracking and traceability. After harvesting and curing, the leaf of tobacco is given a grade, which describes for example the stalk position, quality, and colour.

Further, the lay down step 101 might also include, in case the tobacco is shipped to the manufacturing premises for the production of the homogenized tobacco material, de-boxing or case opening of the tobacco boxes. The de-boxed tobacco is then preferably fed to a weighing station in order to weight the same.

Moreover, the tobacco lay down step 101 may include bale slicing, if needed, as the tobacco leaves are normally compressed into bales in shipping boxes for shipping.

The following steps are performed for each tobacco type, as detailed below. These steps may be performed subsequently per grade such that only one production line is required. Alternatively, the different tobacco types may be processed in separate lines. This may be advantageous where the processing steps for some of the tobacco types are different. For example, in conventional primary tobacco processes bright tobaccos and dark tobaccos are processed at least partially in separate processes, as the dark tobacco often receives an additional casing. However, according to the present invention, preferably, no casing is added to the blended tobacco powder before formation of the homogenized tobacco web.

Further, the method of the invention includes a step 102 of coarse grinding of the tobacco leaves.

Figure 2:
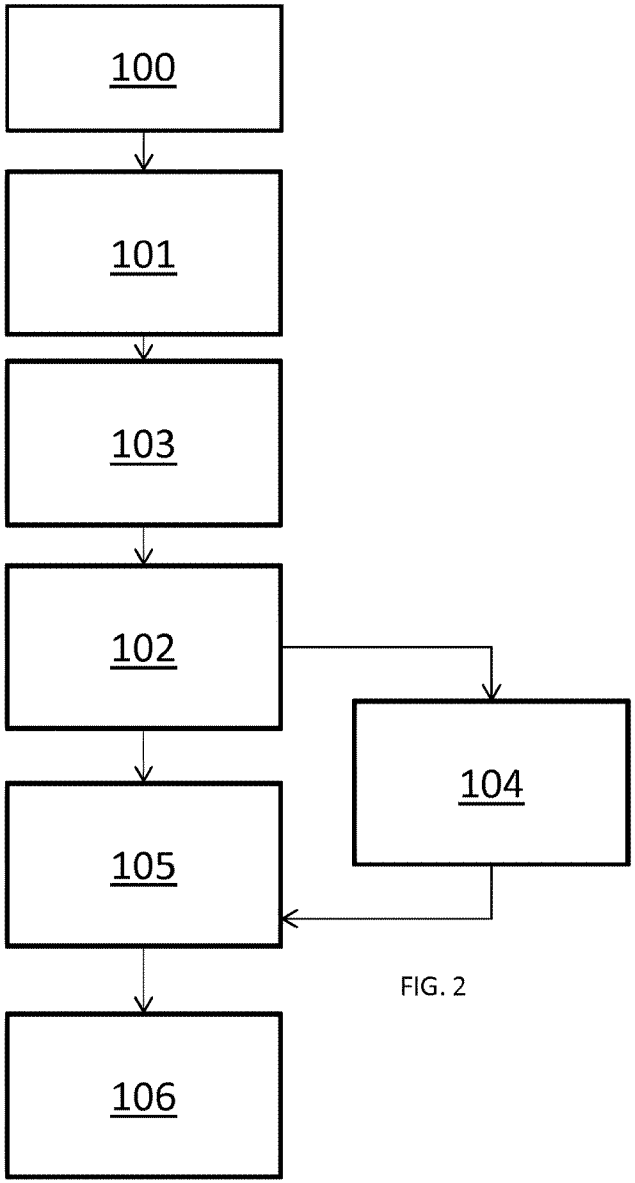
FIG. 2 shows a block diagram of a variant of the method of FIG. 1.

According to a variant of the method of the invention, after the tobacco lay down step 101 and before the tobacco coarse grinding step 102, a further shredding step 103 is performed, as depicted in FIG. 2. In the shredding step 103 the tobacco is shredded into strips having a mean size comprised between about 2 millimetres and about 100 millimetres.

Preferably, after the shredding step 103, a step of removal of non-tobacco material from the strips is performed (not depicted in FIGS. 1 and 2).

Subsequently, the shredded tobacco is transported towards the coarse grinding step 102. The flow rate of tobacco into a mill to coarse grind the strips of tobacco leaf is preferably controlled and measured.

In the coarse grinding step 102, the tobacco strips are reduced to a mean particle size of between about 0.25 millimetres and about 2 millimetres. At this stage, the tobacco particles are still with their cells substantially intact and the resulting particles do not pose relevant transport issues.

The method of the invention may include an optional step 104, depicted in FIG. 2, which includes packing and shipping the coarse grinded tobacco. This step 104 is performed in case the coarse grinding step 102 and the subsequent step of the method of the invention are performed in different manufacturing facilities.

Preferably, after the coarse grinding step 102, the tobacco particles are transported, for example by pneumatic transfer, to a blending step 105. Alternatively, the step of blending 105 could be performed before the step of coarse grinding 102, or where present, before the step of shredding 103, or, alternatively, between the step of shredding 103 and the step of coarse grinding 102.

In the blending step 105, all the coarse grinded tobacco particles of the different tobacco types selected for the tobacco blend are blended. The blending step 105 therefore is a single step for all the selected tobacco types. This means that after the step of blending there is only need for a single process line for all of the different tobacco types.

In the blending step 105, preferably mixing of the various tobacco types in particles is performed. Preferably, a step of measuring and controlling one or more of the properties of the tobacco blend is performed. According to the invention, the flow of tobacco may be controlled such that the desired blend according to a pre-set target value or pre-set target values is obtained. For example, it may be desirable that the blend includes bright tobacco 1 at least for about 30 percent in dry weight basis of the total tobacco in the blend, and that dark tobacco 2 and aromatic tobacco 3 are comprised in a percentage between about 0 percent and about 40 percent in dry weight basis of the total tobacco in the blend, for example about 35 percent. More preferably, also filler tobacco 4 is introduced in a percentage between about 0 percent and about 20 percent in dry weight basis of the total tobacco in the blend. The flow rate of the different tobacco types is therefore controlled so that these ratios of the various tobacco types is obtained. Alternatively, where the coarse grinding step 102 is done subsequently for the different tobacco leaves used, the weighing step at the beginning of the step 102 determines the amount of tobacco used per tobacco type and grade instead of controlling its flow rate.

Figure 4:
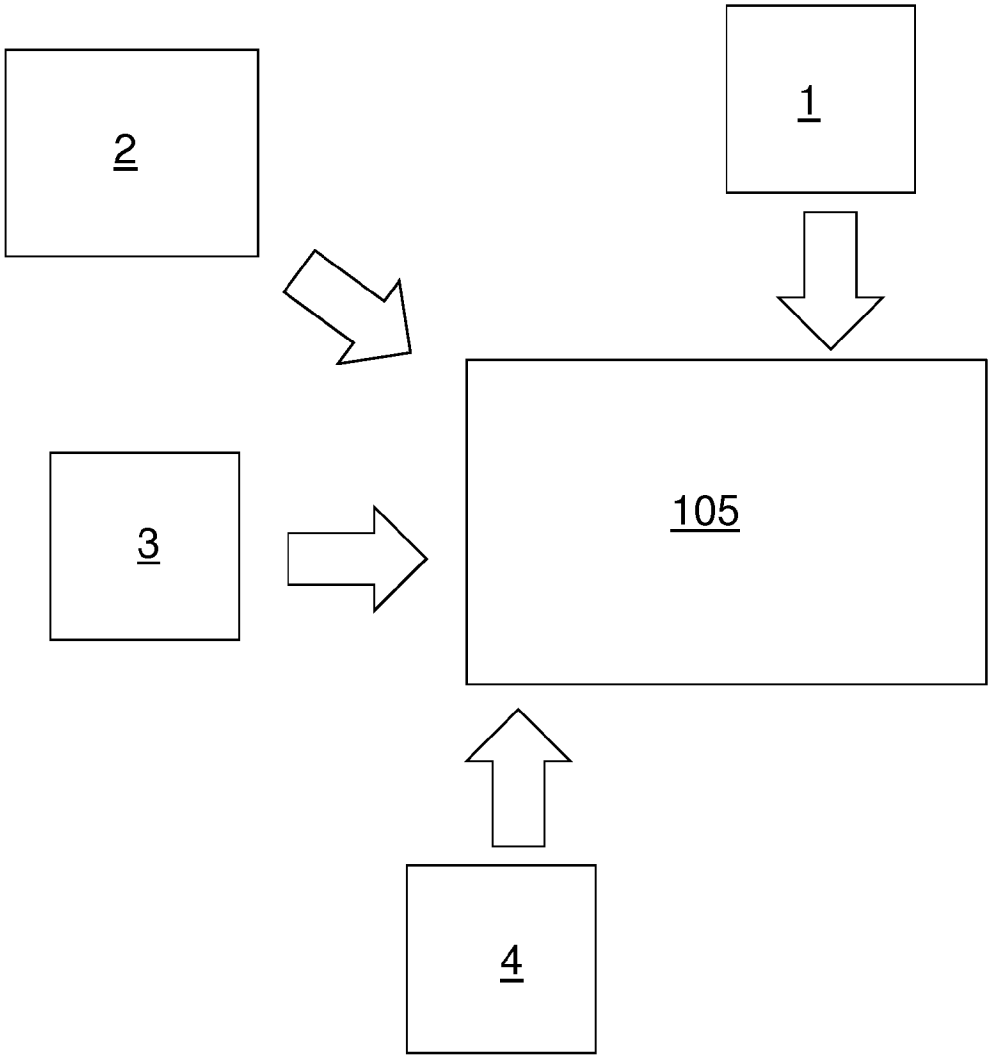
FIG. 4 shows an enlarged view of one of the steps of the method of FIG. 1, 2 or 3.

In FIG. 4, the introduction of the various tobacco types during the blending step 105 is shown.

It is to be understood that each tobacco type could be itself a sub-blend, in other words, the "bright tobacco type" could be for example a blend of Virginia tobacco and Brazil flue-cured tobacco of different grades.

After the blending step 105, a fine grinding step 106, to a tobacco powder mean size of between about 0.03 millimetres and about 0.12 millimetres is performed. This fine grinding step 106 reduces the size of the tobacco down to a powder size suitable for the slurry preparation. After this fine grinding step 106, the cells of the tobacco are at least partially destroyed and the tobacco powder may become sticky.

The so obtained tobacco powder can be immediately used to form the tobacco slurry. Alternatively, a further step of storage of the tobacco powder, for example in suitable containers, may be inserted (not shown).

Figure 3:
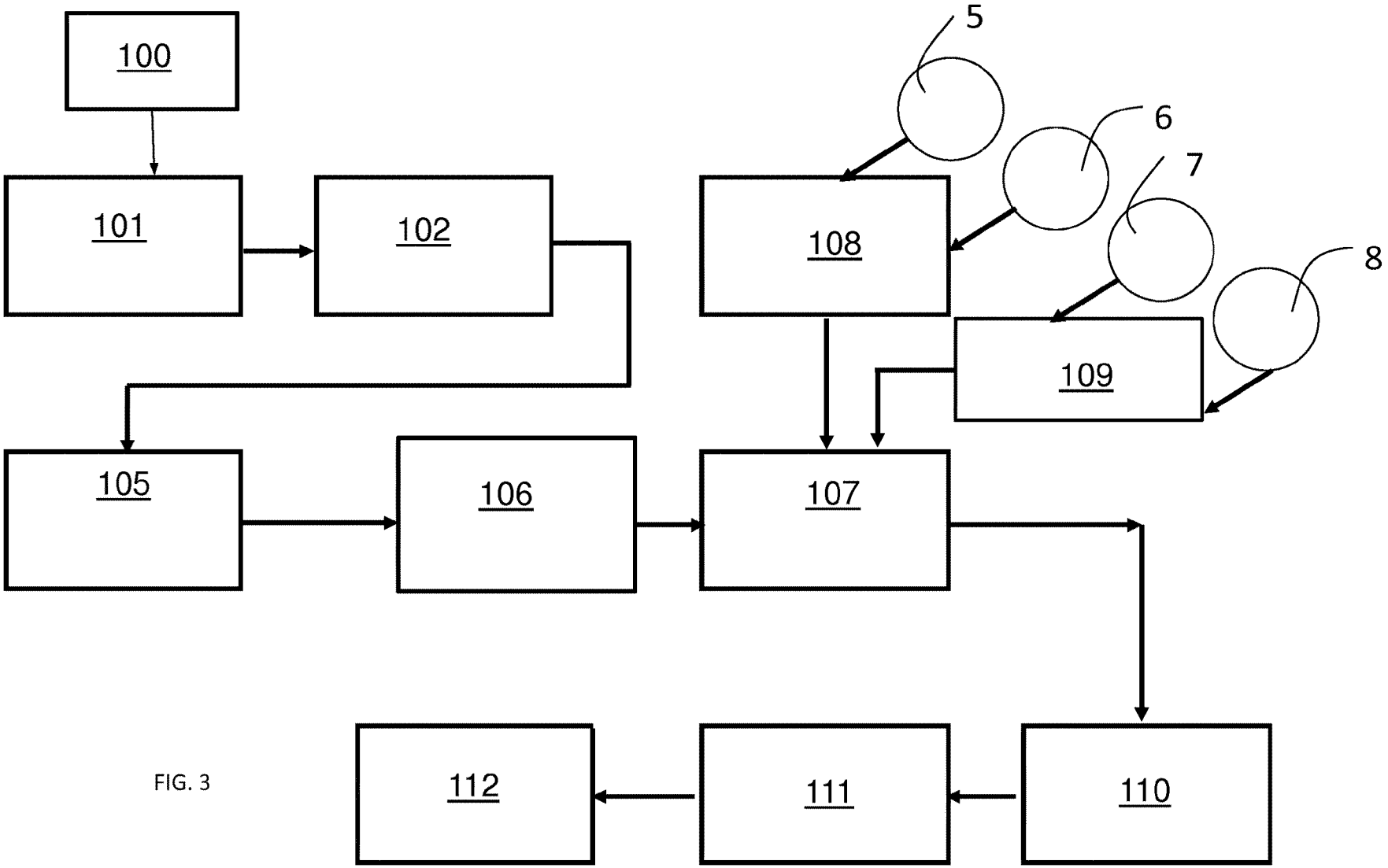
FIG. 3 shows a block diagram of a method for production of a homogenized tobacco material according to the invention.

With reference to FIG. 3, a method of the invention for a manufacture of a homogenized tobacco web is shown. From step 106 of fine grinding, the tobacco powder is used in a subsequent slurry preparation step 107. Prior to or during the slurry preparation step 107, the method of the invention includes two further steps: a pulp preparation step 108 where cellulose fibres 5 and water 6 are pulped to uniformly disperse and refine the fibres in water, and a suspension preparation step 109, where an aerosol-former 7 and a binder 8 are premixed. Preferably the aerosol-former 7 includes glycerol and the binder 8 includes guar. Advantageously, the suspension preparation step 109 includes premixing guar and glycerol without the introduction of water.

The slurry preparation step 107 preferably comprises transferring the premix solution of the aerosol-former and the binder to a slurry mixing tank and transferring the pulp to the slurry mixing tank. Further, the slurry preparation step comprises dosing the tobacco powder blend into the slurry mixing tank with pulp, and the guar-glycerol suspension. More preferably, this step also includes processing the slurry with a high shear mixer to ensure uniformity and homogeneity of the slurry.

Preferably, the slurry preparation step 107 also includes a step of water addition, where water is added to the slurry to obtain the desired viscosity and moisture.

In order to form the homogenized tobacco web, preferably the slurry formed according to step 107 is cast in a casting step 110. Preferably, this casting step 110 includes transporting the slurry to a casting station and casting the slurry into web having a homogenous and uniform film thickness on a support. Preferably, during casting, the cast web thickness, moisture and density are controlled immediately after casting and more preferably are also continuously monitored and feedback-controlled using slurry measuring devices during the whole process.

The homogenized cast web is then dried in a drying step 111 comprising a uniform and gentle drying of the cast web, for example in an endless, stainless steel belt dryer. The endless, stainless steel belt dryer may comprise individually controllable zones. Preferably the drying step comprises monitoring the cast leaf temperature at each drying zone to ensure a gentle drying profile at each drying zone and heating the support where the homogenized cast web is formed. Preferably, the drying profile is a so called TLC drying profile.

At the conclusion of the web drying step 111, a monitoring step (not shown) is executed to measure the moisture content and number of defects present in the dried web.

The homogenized tobacco web that has been dried to a target moisture content is then preferably wound up in a winding step 111, for example to form a single master bobbin. This master bobbin may be then used to perform the production of smaller bobbins by slitting and small bobbin forming process. The smaller bobbin may then be used for the production of an aerosol-generating article (not shown).

Figure 5:
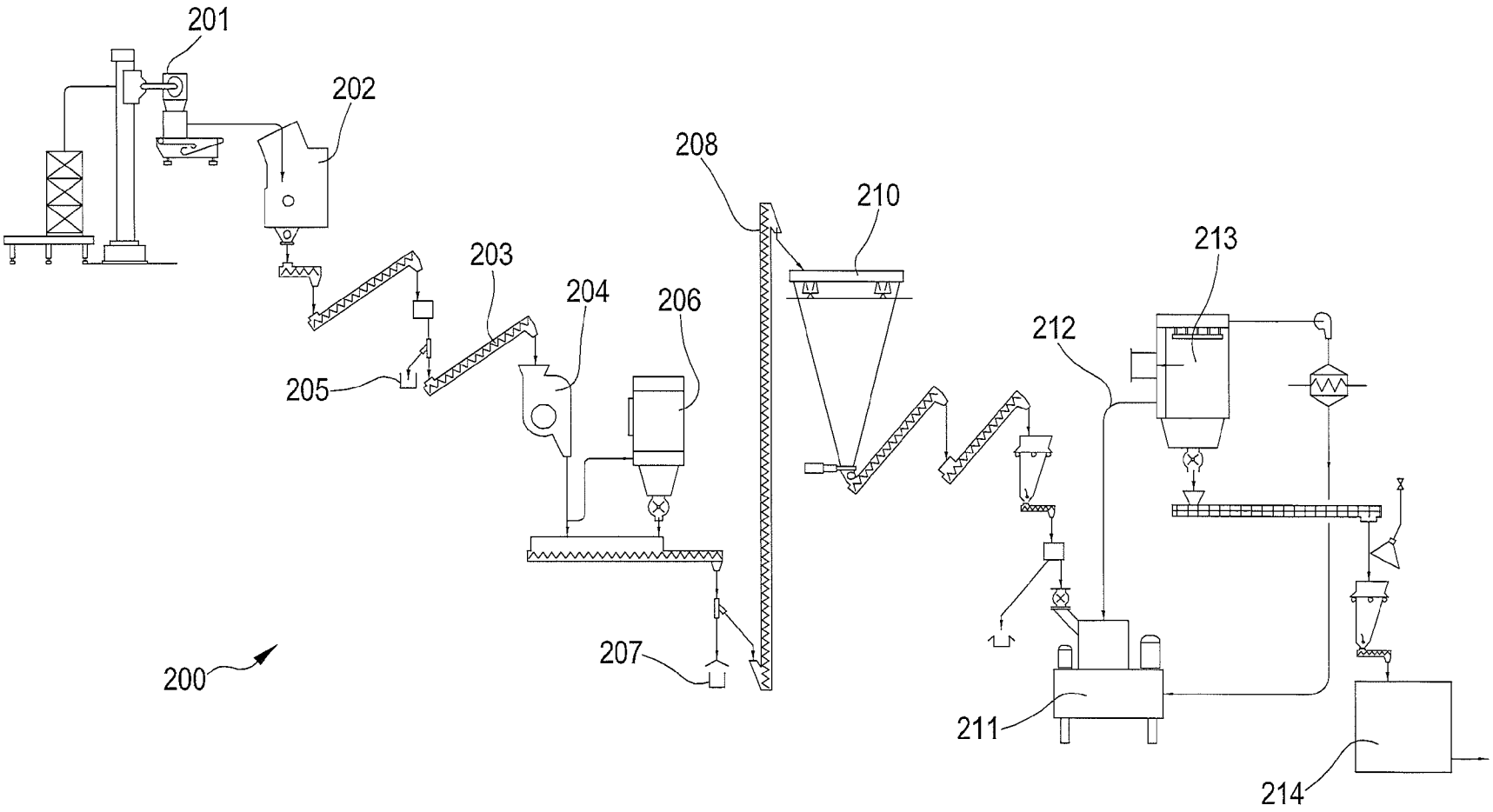
FIG. 5 shows a schematic view of an apparatus for performing the method of FIGS. 1 and 2.

The method of production of a slurry for the homogenized tobacco material according to FIG. 1 or 2 is performed using an apparatus 200 for the production of a slurry depicted schematically in FIG. 5. The apparatus 200 includes a tobacco receiving station 201, where accumulating, destacking, weighing and inspecting the different tobacco types takes place. Optionally, in case the tobacco has been shipped into cartons, in the receiving station 201 removal of cartons containing the tobacco is performed. The tobacco receiving station 201 also optionally comprises a tobacco bale splitting unit.

In FIG. 5 only a production line for one type of tobacco is shown, but the same equipment may be present for each tobacco type used in the homogenised tobacco material web according to the invention, depending on when the step of blending is performed. Further the tobacco is introduced in a shredder 202 for the shredding step 103. Shredder 202 can be for example a pin shredder. The shredder 202 is preferably adapted to handle all sizes of bales, to loosen tobacco strips and shred strips into smaller pieces. The shreds of tobacco in each production line are transported, for example by means of pneumatic transport 203, to a mill 204 for the coarse grinding step 102. Preferably a control is made during the transport so as to reject foreign material in the tobacco shreds. For example, along the pneumatic transport of shredded tobacco, a string removal conveyor system, heavy particle separator and metal detector may be present, all indicated with 205 in the appended drawing.

Mill 204 is adapted to coarse grind the tobacco strips up to a size of between about 0.25 millimetres and about 2 millimetres. The rotor speed of the mill can be controlled and changed on the basis of the tobacco shreds flow rate.

Preferably, a buffer silo 206 for uniform mass flow control, is located after the coarse grinder mill 204. Furthermore, preferably mill 204 is equipped with spark detectors and safety shut down system 207 for safety reasons.

From the mill 204, the tobacco particles are transported, for example by means of a pneumatic transport 208, to a blender 210. Blender 210 preferably includes a silo in which an appropriate valve control system is present. In the blender, all tobacco particles of all the different types of tobacco which have been selected for the predetermined blend are introduced. In the blender 210, the tobacco particles are mixed to a uniform blend. From the blender 210, the blend of tobacco particles is transported to a fine grinding station 211.

Fine grinding station 211 is for example an impact classifying mill with suitable designed ancillary equipment to produce fine tobacco powder to the right specifications, that is, to a tobacco powder between about 0.03 millimetres and about 0.12 millimetres. After the fine grinding station 211, a pneumatic transfer line 212 is adapted to transport the fine tobacco powder to a buffer powder silo 213 for continuous feed to a downstream slurry batch mixing tank where the slurry preparation process takes place.

Figure 6:
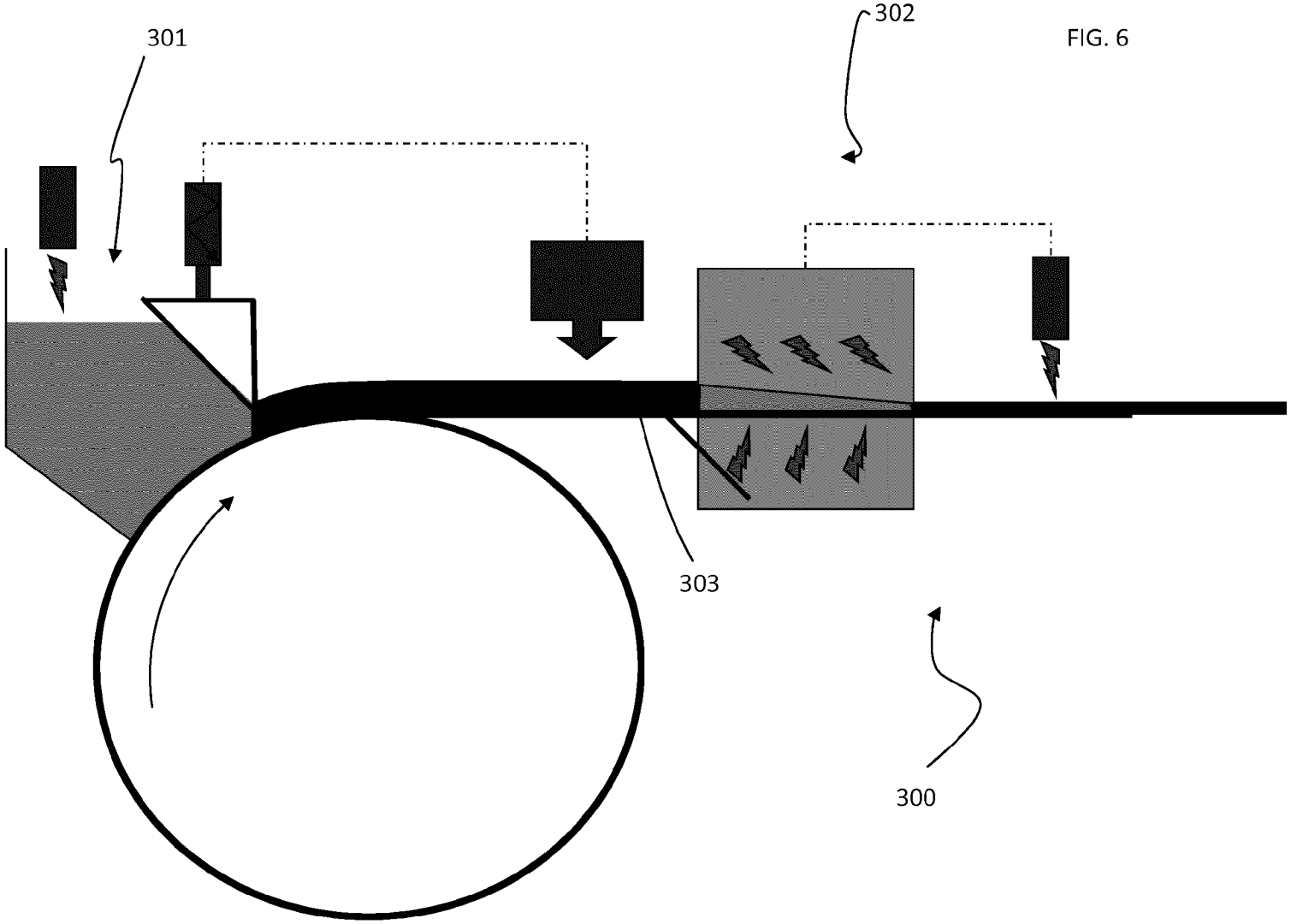
FIG. 6 shows a schematic view of an apparatus for performing the method of FIG. 3.

The slurry which has been prepared using the tobacco powder above described in steps 106, 107 and 108 of the method of the invention is preferably also cast in a casting station 300 as depicted in FIG. 6.

Slurry from a buffer tank (not shown) is transferred by means of suitable pump with precision flow rate control measurement to the casting station 300. Casting station 300 comprises preferably the following sections. A precision slurry casting box and blade assembly 301 where slurry is cast onto a support 303, such as a stainless steel belt with the required uniformity and thickness for proper web formation, receives the slurry from the pump. A main dryer 302, having drying zones or sections is provided to dry the cast tobacco web. Preferably, the individual drying zones have steam heating on the bottom side of the support with heated air above the support and adjustable exhaust air control. Within the main dryer 302 the homogenized tobacco web is dried to desired final moisture on the support 303.

The invention claimed is:

1. A method for producing homogenized tobacco material, the method comprising:

selecting tobacco of two or more tobacco types;

coarse grinding the tobacco;

blending the two or more tobacco types, to form a blend of tobacco, wherein blending the tobacco takes place after coarse grinding the tobacco; and fine grinding the blend of tobacco to form a blend of tobacco powder.

2. The method of claim 1, wherein the fine grinding comprises:

fine grinding the blend of tobacco to obtain a tobacco powder having a mean size between about 0.03 millimeters and about 0.12 millimeters.

3. The method of claim 1, wherein the coarse grinding comprises:

coarse grinding tobacco leaves to obtain tobacco particles of a mean size between about 0.25 millimeters and about 2.0 millimeters.

4. The method of claim 1, further comprising before the coarse grinding:

shredding tobacco leaves of the tobacco to obtain tobacco strips having a mean size between about 2 millimeters and about 100 millimeters.

5. The method of claim 1, wherein the selecting tobacco of two or more tobacco types further comprises selecting:

at least about 30 percent of bright tobacco on dry weight basis of total amount of tobacco in the tobacco blend;

between about 0 percent and about 40 percent of dark tobacco on dry weight basis of total amount of tobacco in the tobacco blend; and between about 0 percent and about 40 percent of aromatic tobacco on dry weight basis of total amount of tobacco in the tobacco blend.

6. The method of claim 1, further comprising:

adding a binder to the blend of tobacco in an amount between about 1 percent and about 5 percent on dry weight basis of the homogenized tobacco material.

7. The method of claim 1 further comprising:

adding an aerosol-former to the blend of tobacco in an amount between about 5 percent and about 30 percent on dry weight basis of the homogenized tobacco material.

8. The method of claim 1, further comprising:

mixing a binder and an aerosol-former before adding the binder and the aerosol-former to the blend of different tobacco types.

9. The method of claim 1, wherein the tobacco blend is in an amount between about 20 percent and about 93 percent on dry weight basis of the homogenized tobacco material.

10. The method of claim 1, further comprising:

adding a cellulose pulp to the blend of tobacco powder in an amount between about 1 and about 3 percent on dry weight basis of the homogenized tobacco material.

11. The method of claim 1 comprising:

forming a slurry including the blend of tobacco powder; and casting a continuous web of the slurry.

12. The method of claim 11, wherein the moisture of the continuous web at casting is between about 60 percent and 80 percent of a total weight of the web.

13. The method of claim 11, further comprising:

drying the cast web;

winding the cast web;

wherein moisture content of the cast web at winding is between about 7 percent and about 15 percent of total weight of the cast web.

* * * * *